US008983106B2

(12) United States Patent
Akino

(10) Patent No.: US 8,983,106 B2
(45) Date of Patent: Mar. 17, 2015

(54) NARROW DIRECTIONAL MICROPHONE

(75) Inventor: Hiroshi Akino, Machida (JP)

(73) Assignee: Kabushiki Kaisha Audio-Technica, Machida-Shi, Tokyo (JP)

( * ) Notice: Subject to any disclaimer, the term of this patent is extended or adjusted under 35 U.S.C. 154(b) by 271 days.

(21) Appl. No.: 13/558,946

(22) Filed: Jul. 26, 2012

(65) Prior Publication Data

US 2013/0034256 A1 Feb. 7, 2013

(30) Foreign Application Priority Data

Aug. 2, 2011 (JP) ..... 2011-169308

(51) Int. Cl.
*H04R 25/00* (2006.01)
*H04R 9/08* (2006.01)
*H04R 1/34* (2006.01)

(52) U.S. Cl.
CPC ..... *H04R 9/08* (2013.01); *H04R 1/342* (2013.01); *H04R 2410/07* (2013.01)
USPC ..... 381/356; 381/357; 381/358; 381/359; 381/360; 381/423

(58) Field of Classification Search
CPC ..... H04R 1/38; H04R 1/34; H04R 1/20; H04R 1/22; H04R 1/222; H04R 1/326; H04R 7/00; H04R 7/02; H04R 7/04; H04R 7/06; H04R 7/045; H04R 7/10; H04R 19/016; H04R 1/086; H04R 1/08; H04R 1/406; H04R 1/342; H04R 1/2807; H04R 1/2867; H04R 1/2869; H04R 1/2876; H04R 2410/07
USPC ..... 381/423–426, 431, 408, 356, 359, 360
See application file for complete search history.

(56) References Cited

U.S. PATENT DOCUMENTS

| | | | | |
|---|---|---|---|---|
| 3,581,012 | A * | 5/1971 | Kishi et al. | 381/91 |
| 4,757,546 | A * | 7/1988 | Akino | 381/357 |
| 6,418,229 | B1 * | 7/2002 | Staat | 381/357 |
| 8,351,630 | B2 * | 1/2013 | Ickler et al. | 381/338 |
| 2004/0125975 | A1 * | 7/2004 | Suzuki et al. | 381/369 |
| 2006/0274913 | A1 * | 12/2006 | Akino | 381/357 |
| 2011/0305359 | A1 * | 12/2011 | Ikeda et al. | 381/356 |
| 2012/0014542 | A1 * | 1/2012 | Akino | 381/174 |
| 2013/0064409 | A1 * | 3/2013 | Ikeda et al. | 381/356 |
| 2013/0216084 | A1 * | 8/2013 | Akino et al. | 381/346 |

FOREIGN PATENT DOCUMENTS

JP 4684012 B2 2/2011

* cited by examiner

*Primary Examiner* — Davetta W Goins
*Assistant Examiner* — Jasmine Pritchard
(74) *Attorney, Agent, or Firm* — Manabu Kanesaka

(57) ABSTRACT

A narrow directional microphone including a film for suppressing wind noise capable of being displaced by a wind pressure, a unidirectional microphone unit having a front acoustic terminal, a cylindrical acoustic tube having a prescribed axial length, and an acoustic resistor disposed at a position which is on an outward side of the film and at which the resistor does not come into contact with the film even when the film is displaced by the wind pressure. A rear end of the acoustic tube is coupled to a side of the front acoustic terminal of the unidirectional microphone unit, and a front end opening of the acoustic tube is covered with the film.

5 Claims, 4 Drawing Sheets

NARROW DIRECTIONAL MICROPHONE

CROSS-REFERENCE TO RELATED APPLICATION

The present application is based on, and claims priority from, Japanese Application Serial Number JP2011-169038, filed Aug. 2, 2011, the disclosure of which is hereby incorporated by reference herein in its entirety.

TECHNICAL FIELD

The present invention relates to a narrow directional microphone using an acoustic tube, and more particularly to a technique that reduces degradation in directional frequency response caused by covering a front end opening of an acoustic tube with a film in order to suppress wind noise and the like.

BACKGROUND ART

In a narrow directional microphone using an acoustic tube, a narrow cylindrical acoustic tube having a prescribed axial length is attached to a front acoustic terminal side, which is a front side of a diaphragm of a unidirectional microphone unit.

Air existing in an acoustic tube serves as an acoustic mass in a low frequency band. The acoustic mass in the low frequency band operates in a manner equivalent to the mass being added to a diaphragm (equivalent to an additional weight to the diaphragm). This facilitates capturing vibration noise.

The acoustic tube is provided with an opening which many sound waves enter (the front end opening or a slit-like opening formed on the wall of the tube). Accordingly, the tube is susceptible to wind noise. Vibration noise and wind noise mainly include low frequency components.

For the purpose of reference, FIG. 4 shows a graph of directional frequency response of a narrow directional microphone using a conventional acoustic tube. This graph indicates that an output level at a low frequency band increases and vibration noise and wind noise largely appear.

Thus, the present assignee has proposed a technique that covers the front end opening of an acoustic tube with a film capable of being displaced by sound waves, mainly for reducing wind noise, in Japanese Patent No. 4684012.

This technique allows the film to prevent low frequency sound waves from passing. Accordingly, wind noise can be reduced. However, in the case where the film is planar, bending of the film by a wind or the like sometimes makes noise that is specific to the film. The invention described in Japanese Patent No. 4684012 uses a film preferably formed into a corrugated shape.

However, even in the case where the film is formed into a corrugated shape, the film has a mass and a stiffness to restore the film to the original position. Accordingly, in a narrow directional microphone having the configuration described in Japanese Patent No. 4684012, resonance occurs owing to the stiffness of the film and the acoustic mass of an air column in the acoustic tube. In an equivalent circuit, the stiffness is represented by a capacitance C, and the acoustic mass is represented by an inductance L.

FIG. 5 shows a graph of directional frequency response measured by the narrow directional microphone having the configuration described in Japanese Patent No. 4684012. In this measurement example, resonance due to the C and L occurs around 200 Hz, showing degradation in directional frequency response. This also means degradation in sound quality.

It is thus an object of the present invention to provide a narrow directional microphone including an acoustic tube having a front end opening covered with a film mainly for reducing wind noise wherein degradation is reduced in directional frequency response due to resonance between the stiffness of the film and the acoustic mass of the air column in the acoustic tube.

SUMMARY OF THE INVENTION

In order to achieve the object, the present invention provides a narrow directional microphone including: a unidirectional microphone unit; and a cylindrical acoustic tube having a prescribed axial length, wherein a rear end of the acoustic tube is coupled to a side of a front acoustic terminal of the unidirectional microphone unit, and a front end opening of the acoustic tube is covered with a film capable of being displaced by a wind pressure, and the microphone further includes an acoustic resistor disposed at a position which is on an outward side of the film and at which the resistor does not come into contact with the film even when the film is displaced by the wind pressure.

According to a preferable mode of the present invention, the microphone further includes an annular spacer disposed between the film and the acoustic resistor to prevent the film and the resistor from being in contact with each other.

Furthermore, any of a nonwoven fabric, a thin metal plate having many pores, and a sponge material having open-cell foam is preferably adopted as the acoustic resistor.

Moreover, it is preferred that the film be made of a thermoplastic resin, and a first irregularity pattern having rough irregularities with a long period and a second irregularity pattern having fine irregularities with a short period be formed over an entire area of the film.

According to the present invention, the acoustic resistor is arranged on the outward side of the film covering the front end opening of the acoustic tube. This arrangement allows the acoustic resistor to suppress series resonance of the film. Accordingly, degradation in directional frequency response due to resonance can be reduced.

DETAILED DESCRIPTION

An embodiment of the present invention will now be described with reference to FIGS. 1 to 3. However, the present invention is not limited thereto.

Figure 1A:
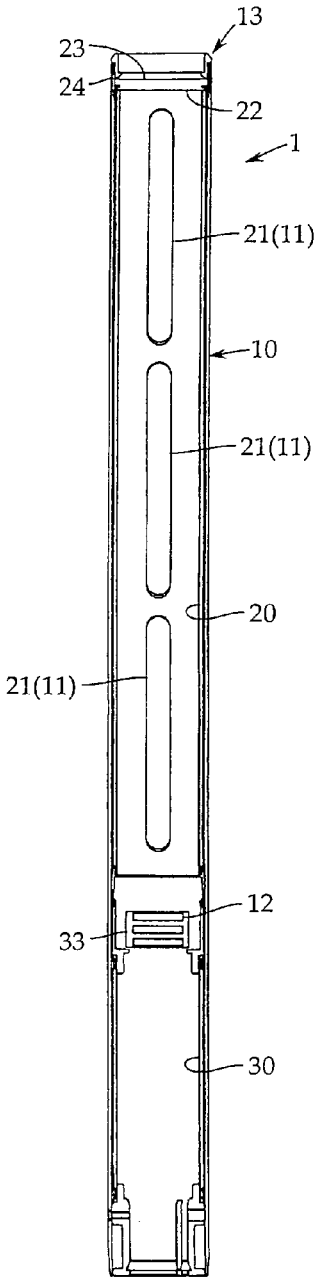
FIG. 1A is a sectional view showing an embodiment of a narrow directional microphone according to the present invention.
Figure 1B:
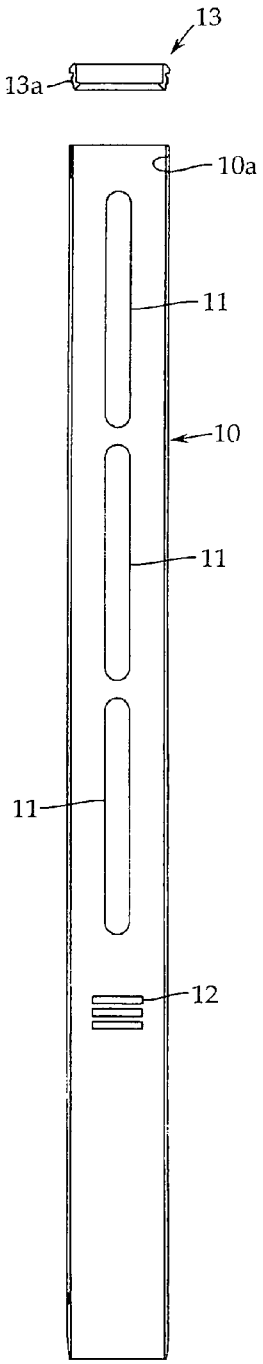
FIG. 1B is a sectional view of an exterior casing applied to the embodiment.
Figure 1C:
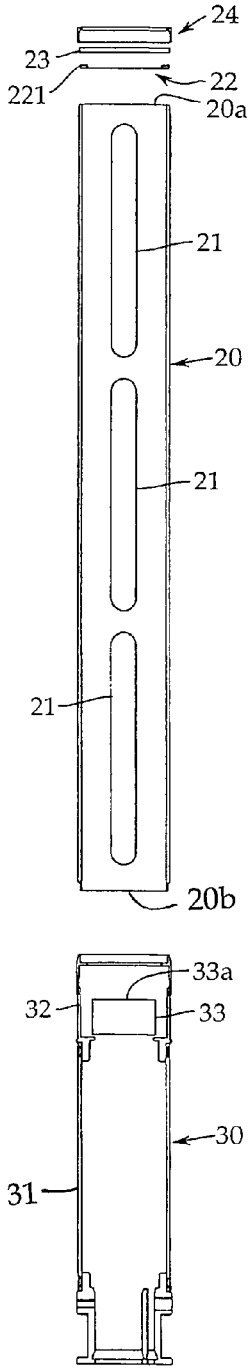
FIG. 1C is a sectional view showing an acoustic tube and a unit section that are accommodated in the exterior casing.

As shown in FIG. 1A, a narrow directional microphone 1 according to an embodiment of the present invention is assembled by accommodating an acoustic tube 20 and a unit section 30 shown in FIG. 1C in an exterior casing 10 shown in FIG. 1B.

The exterior casing 10 has a long cylindrical shape with a length capable of accommodating the acoustic tube 20 and the unit section 30 that are coupled to each other. The material of the exterior casing 10 may be a metal or a plastic.

Slits 11 are formed, at parts of the tube wall of the exterior casing 10 where the acoustic tube 20 is accommodated, along the axial direction thereof. In this example, three slits 11 are formed. However, a continuous slit in which these slits are connected to each other may be adopted.

A stopper ring 13 for preventing the acoustic tube 20 from being separated out is attached to a front end opening of the exterior casing 10. This attachment is made by a female screw 10*a* formed in the front end opening of the exterior casing 10 and a male screw 13*a* formed on the outer periphery of the stopper ring 13 mating with each other.

A rear sound wave intake 12 for a rear acoustic terminal of a unidirectional microphone unit 33 included in the unit section 30 is perforated at a part of the tube wall of the exterior casing 10 where the unit section 30 is accommodated.

The acoustic tube 20 has a cylindrical shape that has an axial length shorter than that of the exterior casing 10 and can be fitted into the exterior casing 10 substantially without a clearance. At the tube wall thereof, slits 21 that are for capturing sound waves and match with the respective slits 11 of the exterior casing 10 are perforated. The slits 11 and 21 may be formed, for instance, at positions opposite to each other and separated by 180° on the tube wall, or at four sets of positions separated by 90°.

In this embodiment, the unit section 30 includes a cylinder 31 and a unit casing 32 that are formed into cylinders having substantially the same diameter. Although not shown, the cylinder 31 accommodates a circuit board on which an audio signal output circuit and the like are mounted. A tripolar (three-pin) output connector to be connected to a phantom power source is provided at the rear end of the cylinder 31.

The unit casing 32 is coupled to the front end of the cylinder 31 and internally includes a unidirectional microphone unit 33. In the narrow directional microphone, a capacitor microphone unit is often adopted as the microphone unit 33.

As shown in FIG. 1, the acoustic tube 20 and the unit section 30 are accommodated in the exterior casing 10 in a state where a rear end 20*b* of the acoustic tube 20 is coupled to the front end of the unit casing 32, that is, on a side of a front acoustic terminal 33*a* of the microphone unit 33. A film 22 that is displaced by a wind pressure is provided at a front end opening 20*a* of the acoustic tube 20 in order to reduce wind noise.

The film 22 is made of thermoplastic resin, such as polyethylene terephthalate and polyphenylene sulfide, and may be a film formed into a corrugated shape. More preferably, a film is adopted that is analogous to a three-dimensionally formed diaphragm described in Japanese Patent Application No. 2008-142067 (Japanese Patent Laid-Open No. 2009-290638) filed by the present assignee.

Figure 2A:
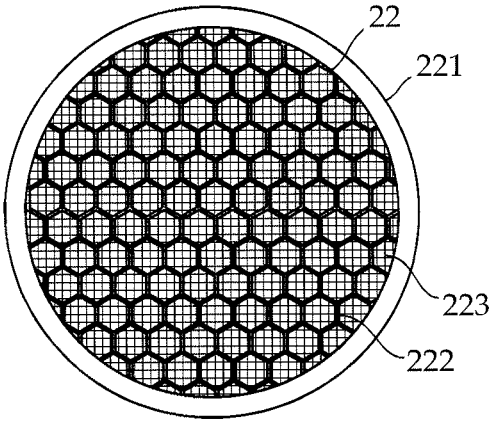
FIG. 2A is a plan view of a film applied to the embodiment.

This film will be described with reference to FIG. 2. As shown in FIG. 2A, the film 22 is stretched over a support ring 221 in a state where a prescribed tension is applied. A first irregularity pattern 222 with rough irregularities having a long period, and a second irregularity pattern 223 with fine irregularities having a period shorter than the long period are formed over the entire area.

Figure 2B:
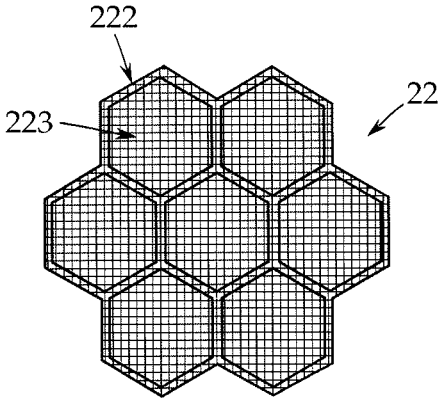
FIG. 2B is a partially enlarged plan view of FIG. 2A.

As shown in FIG. 2B, it is preferred that the first irregularity pattern 222 have a hexagonal honeycomb pattern. The second irregularity pattern 223, in conjunction with the irregularities of the first irregularity pattern 222, is formed across the entire area of the film 22.

Figure 2C:
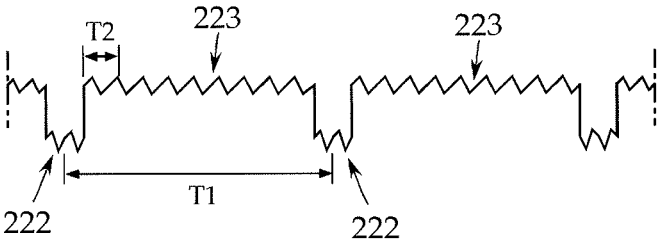
FIG. 2C is a partially enlarged sectional view of FIG. 2A.

Referring to FIG. 2C, the first irregularity pattern 222 has irregularities with a large difference in height. Meanwhile, the second irregularity pattern 223 has many continuous fine irregularities with a height from the bottom to the top of the irregularities equal to or larger than the thickness of the film.

Here, provided that the period (one pitch) of the first irregularity pattern 222 is denoted by T1 and the period (one pitch) of the second irregularity pattern 223 is denoted by T2, it is preferred that the period T1 be at least ten times as long as the period T2.

That is, it is preferred that at least ten irregularities of the second irregularity pattern 223 exist between the irregularities of the first irregularity pattern 222. Such a film 22 can be easily formed by a press machine including a heated die.

As shown in FIGS. 1A and 1C, the film 22 in the state of being stretched over the support ring 221 is attached to the acoustic tube 20 so as to cover the front end opening 20*a* where the support ring 221 is oriented outwardly (on a side opposite to the acoustic tube). In the present invention, an acoustic resistor 23 is further arranged on the outward side of the film 22 (on the side opposite to the acoustic tube).

A nonwoven fabric formed into a flat plate, a thin metal plate having many pores, or a sponge material having open-cell foam (porous material having open-cell foam) is preferably adopted as the acoustic resistor 23. The acoustic resistor 23 is disposed at a position that does not come into contact with the film 22 even when the film 22 is displaced by a wind pressure.

In this embodiment, the support ring 221 of the film 22 serves as a spacer ring for holding the acoustic resistor 23 so as not to be contact with the film 22. The film 22 and the acoustic resistor 23 are fixed to the front end opening 20*a* of the acoustic tube 20 with an annular holder ring 24. As shown in FIG. 1A, the holder ring 24 is finally held by the stopper ring 13.

The acoustic resistor 23 is thus arranged on the outward side of the film 22 for reducing wind noise in a non-contact state. This arrangement suppresses series resonance between the stiffness of the film 22 and the acoustic mass of the air column in the acoustic tube 20. Accordingly, degradation in directional frequency response due to resonance can be reduced.

Figure 3:
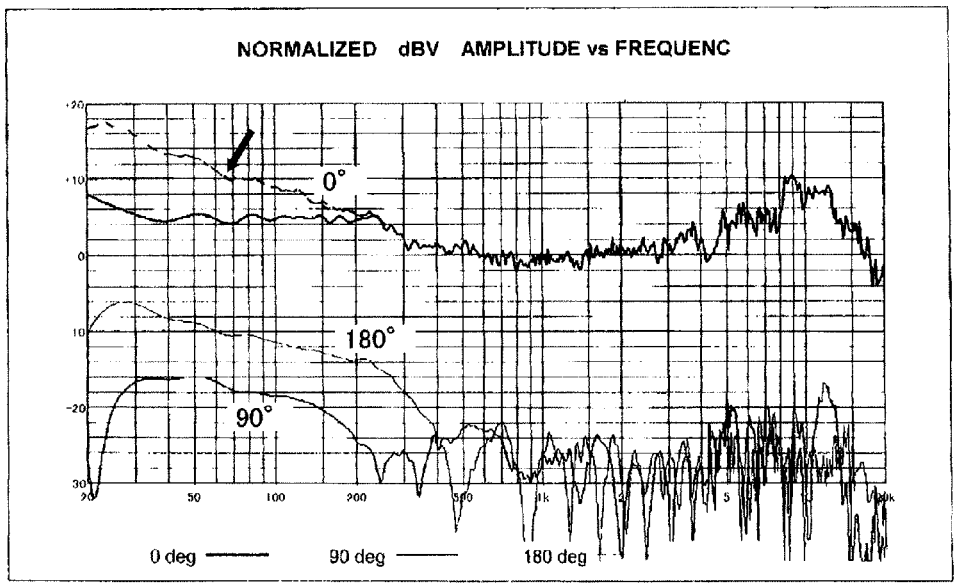
FIG. 3 is a graph showing directional frequency response measured in the embodiment.
Figure 4:
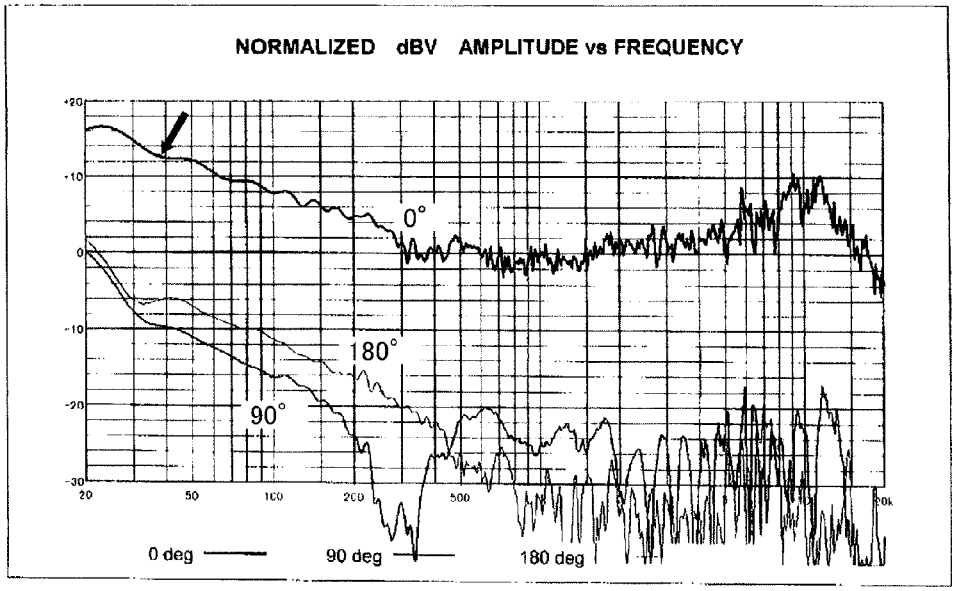
FIG. 4 (RELATED ART)
FIG. 4 is a graph showing directional frequency response of a conventional, typical narrow directional microphone.
Figure 5:
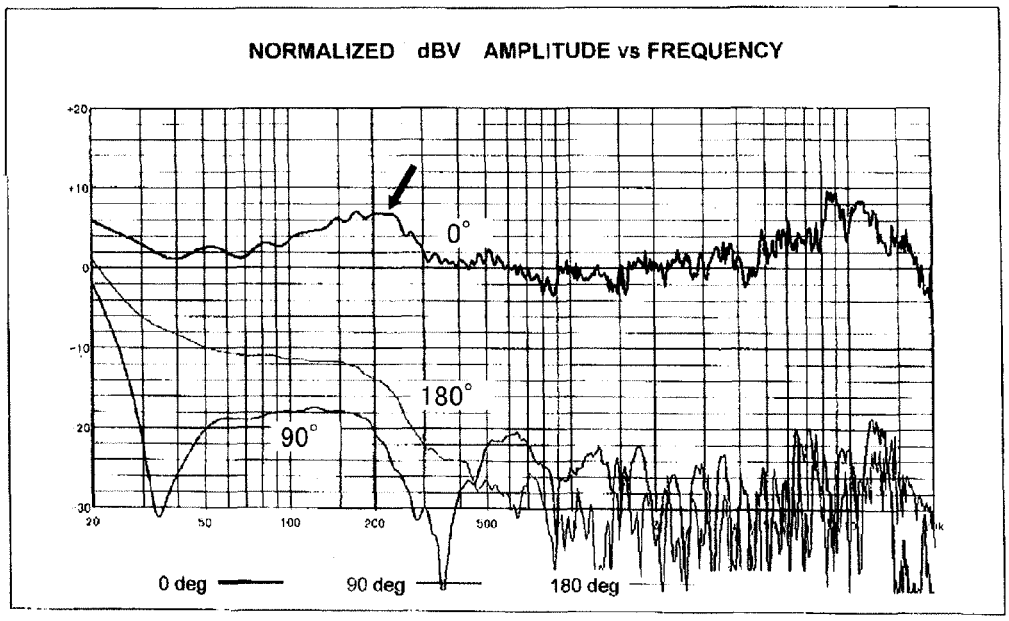
FIG. 5 (RELATED ART)
FIG. 5 is a graph showing directional frequency response of a narrow directional microphone having a film over a front end opening of an acoustic tube.

FIG. 3 exemplifies a graph of directional frequency response measured by a narrow directional microphone adopting an acoustic resistor plate that has an outer diameter of 24.2 mm made of a nonwoven fabric JH-1007 (made of polyester fiber and having a surface density of 70 g/m$^2$ and a thickness of 0.13 mm) manufactured by Japan Vilene as the acoustic resistor 23 and has a separation from the film 22 of 0.8 mm, the film 22 having a effective vibration diameter of about 20 mm.

This graph shows that the series resonance of the film 22 is sufficiently suppressed and, more specifically, the output level in a low frequency band is flattened and acoustic capacity according to the capacity of an air room in the acoustic tube 20 does not degrade acoustic movement in medium and high frequencies.

The embodiment adopts the configuration accommodating the acoustic tube 20 and the unit section 30 in the exterior casing 10. However, the exterior casing 10 is not necessarily adopted. In the case without the exterior casing 10, the unit casing 32 of the unit section 30 may be provided with the rear sound wave intake 12 for the rear acoustic terminal of the unidirectional microphone unit 33.

The invention claimed is:

1. A narrow directional microphone, comprising:

a unidirectional microphone unit having a front acoustic terminal;

a cylindrical acoustic tube attached to a front side of the unidirectional microphone unit and having a prescribed axial length;

a film for suppressing wind noise, attached to a front side of the acoustic tube to be displaced by a wind pressure; and an acoustic resistor attached to the acoustic tube at a position further front side relative to the film such that the acoustic resistor does not contact the film even when the film is displaced by the wind pressure, wherein a rear end of the acoustic tube is coupled to the front acoustic terminal of the unidirectional microphone unit, and a front end opening of the acoustic tube is covered with the film and the acoustic resistor so that series resonance between stiffness of the film and an acoustic mass of an air column in the acoustic tube is suppressed.

2. The narrow directional microphone according to claim 1, further comprising an annular spacer disposed between the film and the acoustic resistor to prevent the film and the resistor from being in contact with each other.

3. The narrow directional microphone according to claim 1, wherein the acoustic resistor is made of any of a nonwoven fabric, a thin metal plate having many pores, and a sponge material having open-cell foam.

4. The narrow directional microphone according to claim 1, wherein the film is made of a thermoplastic resin, and a first irregularity pattern having rough irregularities with a long period and a second irregularity pattern having fine irregularities with a short period are formed over an entire area of the film.

5. The narrow directional microphone according to claim 4, wherein the first irregularity pattern has a hexagonal honeycomb pattern.

* * * * *